United States Patent [19]

Peverley

[11] Patent Number: 4,989,906

[45] Date of Patent: Feb. 5, 1991

[54] DEVICE FOR TYING AN ELASTIC BALLOON

[76] Inventor: John F. Peverley, 3341 Terrywood Rd., Fort Collins, Colo. 80524

[21] Appl. No.: 390,632

[22] Filed: Aug. 7, 1989

[51] Int. Cl.[5] ..... D03J 3/00; B65H 69/04

[52] U.S. Cl. ..... 289/17; 289/18.1

[58] Field of Search ..... 289/1.5, 2, 13, 15, 289/17, 18.1; 53/134, 135, 136, 138 A, 139.3, 370; 446/222; 223/46

[56] References Cited

U.S. PATENT DOCUMENTS

| | | | |
|---|---|---|---|
| 1,680,318 | 8/1928 | Callahan | 446/222 |
| 1,783,001 | 11/1930 | Raetz | 289/17 |
| 2,396,906 | 3/1946 | Windson | 46/90 |
| 2,882,645 | 4/1959 | Stivers | 46/88 |
| 3,161,998 | 12/1964 | Lennox | 53/7 |
| 3,223,440 | 12/1965 | Rosenzweig | 223/46 |
| 3,267,604 | 8/1966 | Goldsmith | 46/88 |
| 3,476,423 | 11/1969 | Kentfield | 289/17 |
| 3,783,551 | 1/1974 | Allison et al. | 46/90 |
| 3,911,974 | 10/1975 | Kuykendall | 141/94 |
| 4,510,653 | 4/1985 | Semanko | 24/131 |
| 4,802,877 | 2/1989 | Davis et al. | 446/222 |
| 4,809,483 | 3/1989 | Lovik | 53/434 |
| 4,809,484 | 3/1989 | Lovik | 53/434 |

FOREIGN PATENT DOCUMENTS

| | | | |
|---|---|---|---|
| 440400 | 2/1927 | Fed. Rep. of Germany | 223/46 |
| 830933 | 1/1952 | Fed. Rep. of Germany | 223/46 |
| 454665 | 7/1913 | France | 223/46 |

OTHER PUBLICATIONS

The "Balloon Knotter" from *Balloons Today* Catalog (Oct. 1989 iss.), New Product Brochure from Skully Industries, date unknown.

*Primary Examiner*—Werner H. Schroeder
*Assistant Examiner*—Michael A. Neas
*Attorney, Agent, or Firm*—Luke Santangelo

[57] ABSTRACT

A device for tying an elastic balloon is disclosed. The nonmovable device defines a hole through which the neck of the balloon may be passed to form the knot in the neck. An opening at the edge of this hole facilitates removal once the knot has been formed. The device utilizes tabs and orthogonal retaining and restraining elements to simplify its utilization by either left- or right-handed people. No separate member remains with the balloon once the sealing through means of forming a knot has been affected. In addition, no parts of the device move and thus it greatly facilitates inexpensive and simple utilization in a repetitive fashion. Through the disclosure of several different embodiments, variations of the basic design are disclosed to enhance the possibility of inexpensive manufacture.

3 Claims, 3 Drawing Sheets

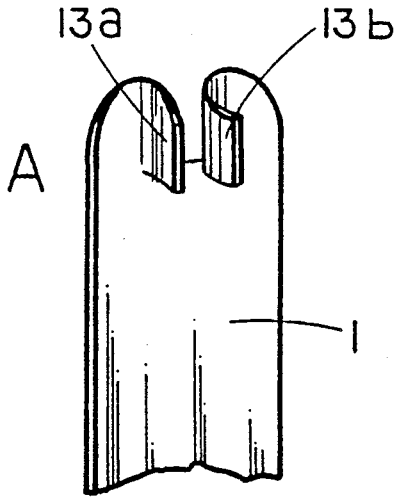
FIG. 5
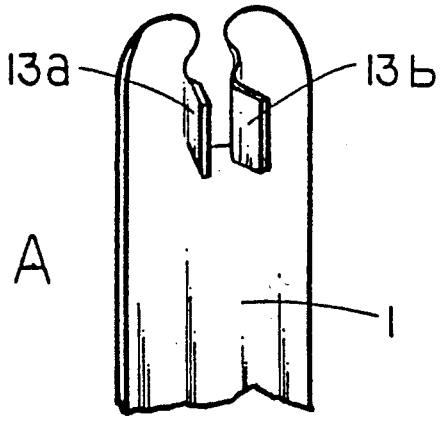
FIG. 6
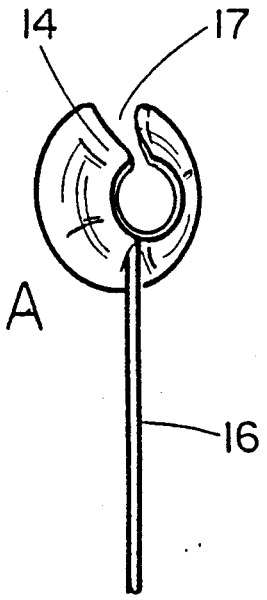
FIG. 7
FIG. 8
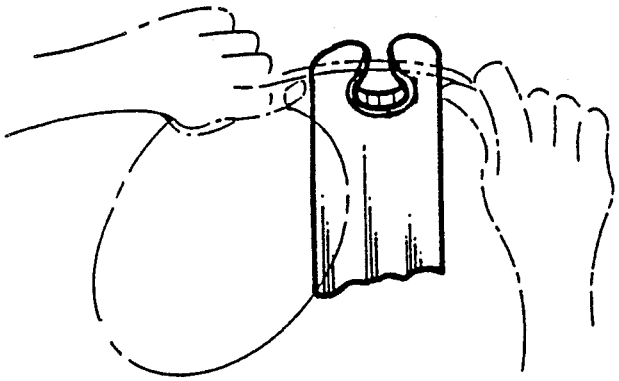

DEVICE FOR TYING AN ELASTIC BALLOON

BACKGROUND OF THE INVENTION

This invention relates to the field of tying elastic balloons such as a latex balloon. More specifically, the invention relates to mechanical devices which facilitate quick and easy knotting of the neck of an elastic balloon or balloons.

One of the most inexpensive and widely-utilized items of decoration is the elastic balloon. So widespread is this decorative item that it is hard to imagine any child who has ever had a birthday not being thoroughly familiar with the delight associated with simple party balloons. Certainly every person who has ever utilized an inflated balloon is well aware that sealing the end of a balloon—while capable of being done through the use of a clamp—usually is accomplished through the dextrous feat of manually tying the balloon. The significance of this task is especially brought to light when one considers that the recent trend toward utilizing large numbers of balloons for special occasions necessitates the repetition of this task for long periods of time. Although devices have existed for some time to seal balloons, one of the primary elements of this decorative technique is its low cost and simplistic use. The utilization of separate devices to seal inflated elastic balloons has therefore not met with great acceptance.

An example of the types of inventions which have existed to separately seal an elastic balloon covers a broad range of designs. In U.S. Pat. No. 1,680,318, a separate assembly disk is proposed which utilizes a rubber string to separately seal an inflated elastic balloon. Similarly, in U.S. Pat. No. 2,396,906a balloon sealing device which wraps the neck of the balloon around the device thereby effecting the seal is also disclosed. More recently, U.S. Pat. No. 3,783,551 shows a more refined device again which separately seals the elastic balloon. Finally, U.S. Pat. No. 4,802,877 provides a separate sealing device designed not for elastic balloons but rather particularly suited as a separate device to seal the unique metalized film balloons as have recently become popular.

As stated above, none of these designs focuses on the need to cheaply and simply tie the balloon neck itself and thus effect sealing of the balloon. In U.S. Pat. No. 4,510,653, an effort was made to facilitate this particular need. That patent, entitled "Method and Apparatus for Tying Balloons and the Like" utilizes the movable jaw action of a simple clothes pin to hold the neck portion of an inflated balloon while the looped portion is rolled off the device thus resulting in a knotted balloon. Unfortunately, that design does not lend itself to the simple and quick utilization necessary for repetitive use. It may even require more intricate manipulation than that necessary to manually tie an elastic balloon without assistance. Although that design (like the separate devices proposed earlier) recognizes the need to assist one in the need to simply and cheaply effect a seal of an elastic balloon, none of these designs have satisfied the need to utilize the balloon itself to effect the seal without requiring difficult manipulation of the balloon. The limitation of these prior inventions can be understood when it is recognized that those skilled in the art had, in almost every case, utilized a separate device to either permanently effect the seal or to temporarily effect the seal while other manipulation was achieved. They simply taught away from the present invention which utilizes the inherently understood technique of knotting a balloon while avoiding the difficulty inherent to an elastic, inflated work piece. The prior inventions simply taught away from the simple task of utilizing the balloon itself to effect the seal. Those skilled in the art assumed that it was not possible to simplify the knotting task through use of a separate device without providing additional steps of clamping the balloon while the device was utilized.

Accordingly, the present invention focuses on providing a device which is reusable, which simplifies the knotting process, which is inexpensive, and—perhaps above all—can be repetitively utilized without difficulty. As a key element the device provides a design having a permanent hole through which the knot can be effected. In addition an opening is provided to allow simple removal of the balloon once the knot has been formed. Another important element of the present invention is the fact that no movable parts are involved. This not only greatly enhances the device's cost-effectiveness, but avoids any problem with the device wearing out as repetitive use was a focus from the start.

SUMMARY OF THE INVENTION

It is broadly an object of the present invention to provide a design which simplifies the task of sealing an elastic balloon. In accordance with the need to keep such a design as cost-effective as possible, the device provides a design which is nonmovable and inexpensive.

It is a further object of the present invention to present a device which may be utilized in conjunction with the simple task of knotting the neck of an elastic balloon. The device facilitates this task and results in producing a knot in the neck of an elastic balloon as is well known.

Another object of the present invention is to provide a device which can be cheaply and simply manufactured. The various embodiments proposed by this invention each can be inexpensively manufactured and utilized.

A further object of the present invention is to provide a design which may be utilized for either left- or right-handed persons to knot elastic balloons.

Another object of the present invention is to provide a design which can be utilized to tie the necks of more than one balloon together in one simple operation.

Naturally further objects of the invention are disclosed throughout other areas of the specification and claims.

BRIEF DESCRIPTION OF DRAWINGS

FIG. 5 is a perspective view of another embodiment which utilizes tabs as the retaining element.

FIG. 6 is a perspective view of a similar embodiment shown in FIG. 5, but having tabs recessed from the end of the bracket.

FIG. 7 is a perspective view of still another embodiment having a rod-like bracket and a fused grommet serving as the retaining element.

FIG. 8 is a front view of the embodiment in FIG. 2 and shows the stretching of a balloon neck portion across an opening.

DETAILED DESCRIPTION OF THE PREFERRED EMBODIMENTS

Figure 1:
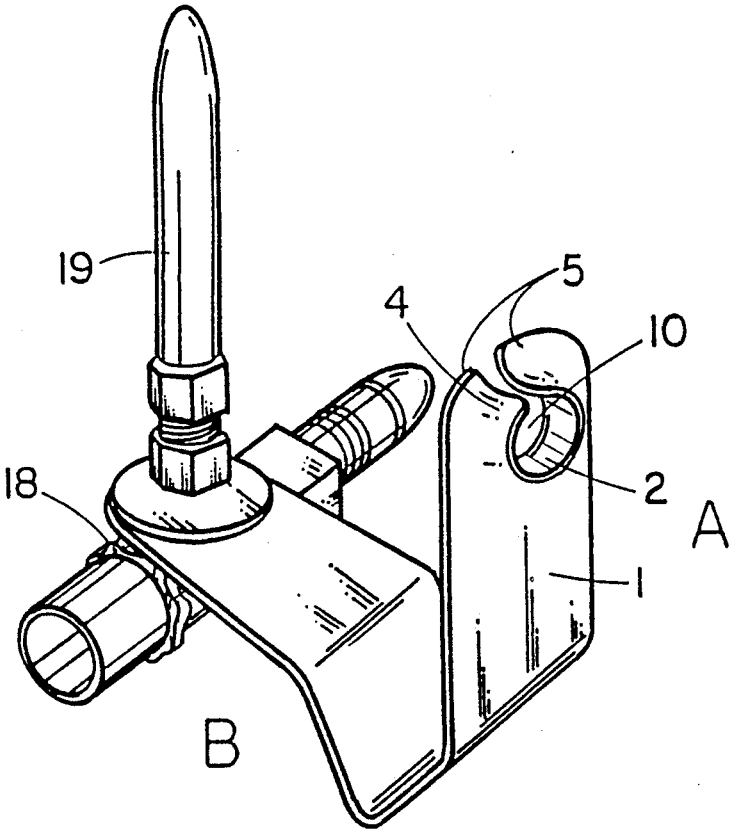
FIG. 1 is a perspective view of an embodiment of the invention mounted to a gas tank.

As can be seen from the drawings, the basic concepts of the present invention may be embodied in many different ways. FIG. 1 shows one embodiment of the invention in perspective. Bracket (1) is connected to retaining element (2) having a distal end (8) including opening (3), which acts as a means for removal of the tied balloon. The ends of retaining element (2) are discussed as being distal (8) and proximal (9) with respect to bracket (1) and point of attachment (6). FIG. 1 demonstrates a particularly useful mounting method of the invention. Bracket (1) is mounted to regulator-inflator (18) in a vertical fashion, with flexible valve (19), specifically used for filling balloons, attached likewise.

An important feature of the invention is that the size of the opening (3) is designed as a function of the balloon neck size and the user's finger size. This non-expandable, non-collapsible opening (3) facilitates the removal of the balloon after it has been tied. Opening (3) not only serves as the means of the removal of the tied balloon, but also as a means to avoid premature removal. That is, opening (3) has the dimension of $\frac{1}{4}$ of an inch, which is sufficiently large enough to pass the neck of the balloon, but prevents the user, whose finger is too large to pass through opening (3), from pulling the balloon off while feeding the neck of the balloon through retaining element (2). It should be apparent that finger sizes will vary, and therefore opening (3) may be designed to vary as well. However, the stated dimension above has been found to work ideally for a large range of finger sizes.

Also, an important feature of this invention is that the size of retaining element (2) is a function of the balloon neck length. This relationship will be made clear in the text to follow. Retaining element (2) further has rounded edges (7) to help avoid tearing the balloon during the tying process and removal of balloon. Because the edge of distal end (8) includes opening (3) it should be noted that opening (3) is also designed with rounded edges (7).

Figure 2:
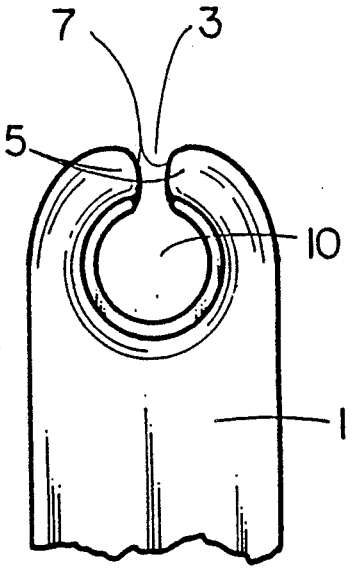
FIG. 2 is a front view of the "head" portion of the embodiment shown in FIG. 1.

Referring to FIG. 2, a front view of the embodiment shown in FIG. 1, it can be seen that opening (3) has distinct and separate left and right sides. These left and right sides shall herein be defined as orthogonol tabs, which are substantially perpendicular to retaining element (2) and referred henceforth as retention element (5) of this embodiment. Retention element (5) holds the balloon neck in place during the tying process. Furthermore, retention element (5) enables this invention to be used equally effective by both right-handed and left-handed persons, because of its symmetry. Naturally this device can be designed with only one side if need be.

Figure 3:
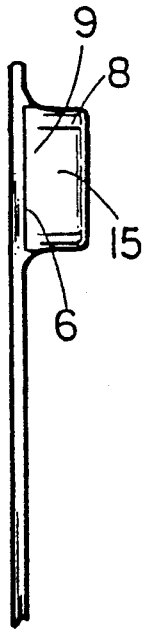
FIG. 3 is a side view of the embodiment shown in FIG. 2.

Referring to FIG. 3, a side view of the same embodiment, additional features of this invention can be understood. As can be seen, retaining element (2) is connected at all points on its proximal end (9) to bracket (1). These points of connection are collectively defined as intersection (4), and along intersection (4) is inferred to mean any or all of these points. In addition, intersection (4) is filled in to form a radius which aid in reducing friction. This matter of friction shall be taken up later in this text. The radius is a smooth, sloped surface that disallows the balloon neck from being caught or snagged in intersection (4). Retaining element (2) has an outside diameter of 1 inch, although it is certainly obvious that other dimensions will work for very large or very small balloons. Furthermore the depth of retaining element (2), which may also come in various lengths, helps to keep balloon neck portion on retaining element (2) during tying process. In the cases of both the diameter and depth of retaining element (2) these stated sizes have been found to be the best.

Retaining element (2) may be designed so that it narrows from its proximal end (9) to its distal end (8) to aid in the removal of the balloon once the removal process has begun and not before. From a manufacturing stand point, the use of a tapered retaining element (2) would simplify any molding of this invention because the taper would allow for the molded device to be removed more easily. Taper of both point of contact (6) and retaining element (2) may be of varying degrees. A further aspect to facilitate removal of the balloon is the use of a smooth external surface on retaining element (2). To reduce friction between the balloon and this external surface, which is contacted by the neck of the inflated balloon, the use of TEFLON (poly(tetrafluoroethylene)) or silicon as a coating to this surface may be used.

Referring to FIGS. 1, 2 and 3, the relative dimensions of several elements may be realized. However, these stated measurements are only to be taken as one possible design with an indefinite number of fractional deviations. In this embodiment retaining element (2) may be a tube with a one inch outside diameter and a thickness of 1/16 of an inch resulting in an approximate $\frac{7}{8}$ inch inside diameter. Note also that hole (10), is defined by the edge of retaining element (2) and has a rim along edge defining a plane lying in the plane of bracket (1) and perpendicular to retaining element (2), has the shape of a circle. This shape of hole (10) is inconsequential to the function of this invention and therefore should not be considered as the only shape possible or significant.

Moreover, bracket (1) is shown as a 2 inch flat, planar element. However, bracket (1) as stated earlier, may be designed with a variety of lengths and thicknesses, and furthermore, a number of more aesthetically pleasing contours may be added.

As can be seen from FIGS. 4, 5, 6 and 7, it is possible to make certain alterations to elements of the prior embodiment without destroying the inherent function of the invention.

Figure 4:
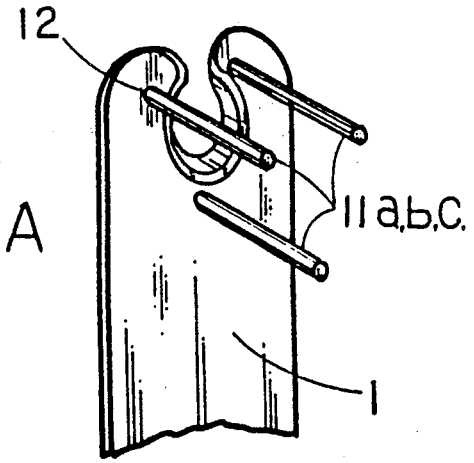
FIG. 4 is a perspective view of another embodiment which substitutes three rods for the tube as the retaining element.

FIG. 4 shows retaining element (11) as three rods (11*a–c*) protruding from bracket (1) and connected at all points of their proximal ends (12). All other elements of this invention remaining unchanged, this device will perform the same functions as the prior embodiment. Similar to retaining element (2) of the prior embodiment, rods (11*a–c*) may be tapered toward an equidistant point at their distal ends to facilitate removal of the tied balloon, making sure that taper is not so great as to hinder its primary function of retaining balloon neck during the tying process.

FIGS. 5 and 6 show a perspective view of embodiments which make use of tabs (13) punched out of bracket (1). Tab (13*a* and *b*) may be recessed from one end of bracket (1), as in FIG. 6, to provide the device with retention element (5), or merely punched from end of bracket (1) as in FIG. 5. In either case the device is inexpensively and readily manufactured.

Another embodiment, as can be seen in FIG. 7, is essentially a grommet (14) (or similarly-shaped element) attached at a point on its external surface (15) to a rod-like bracket (16). Grommet (14) defines a slit (17) that, when expanded to a predetermined width, serves to function as opening (3) of earlier embodiments. Rod-like bracket (16) allows for mounting of device into any hole of the same size.

Use of this invention in its various embodiments can be understood as follows. First of all, invention should be mounted, in any particular manner, to allow the user two free hands. Mounting of invention as seen in FIG. 1, can best be done by fastening "foot" (B) to balloon inflating mechanism, table, platform or the like. This procedure provides great stability to invention during tying process which is described as follows.

Figure 9:
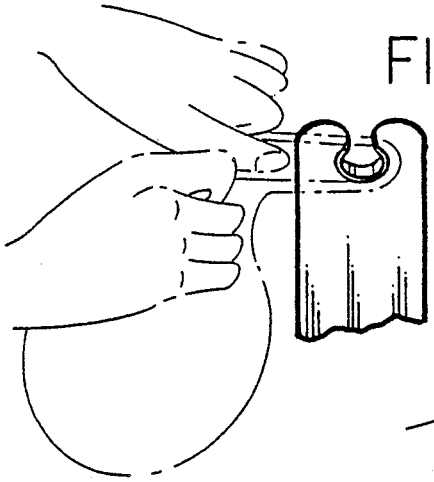
FIG. 9 is another front view of FIG. 2, and shows a balloon neck portion being wrapped around the retaining element.
Figure 10:
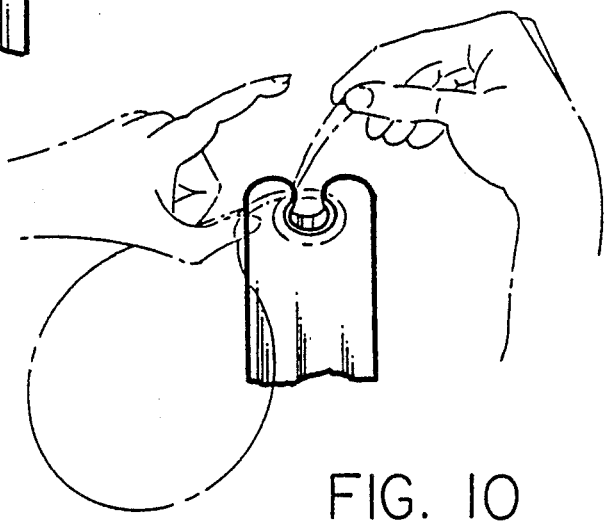
FIG. 10 is another front view of FIG. 2, and shows a balloon neck portion being fed between retaining elements.
Figure 11:
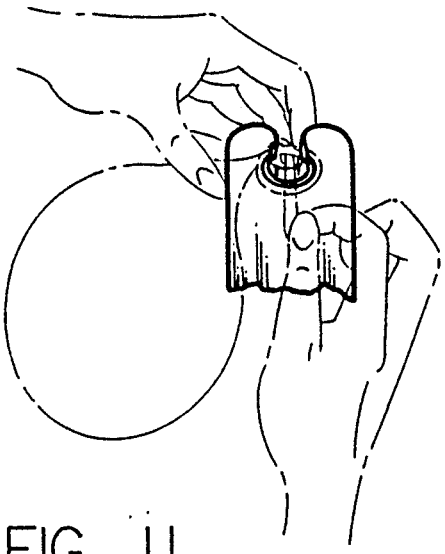
FIG. 11 is another front view of FIG. 2, and shows the balloon neck portion being fed through the hole defined by the edge of the retention element with left index finger and grabbed between right index finger and thumb.
Figure 12:
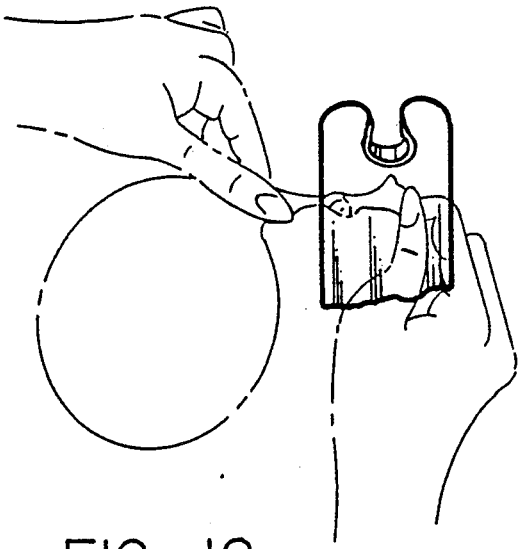
FIG. 12 is another front view of FIG. 2, and shows balloon neck portion after removal from retaining element to form a knot.

Referring to FIGS. 8 and 9, the inflated balloon neck is slightly stretched and wrapped about retaining element (2). One loop around retaining element (2) is preferred to form the desired knot, however, any number of loops may be used. Next, referring to FIGS. 10 and 11, the open end of balloon neck is fed between left and right sides of retention element (5) and through opening (3), then back through hole (10) of retaining element (2). This same end as can be seen in FIGS. 11 and 12, having exited retaining element (2) is then grabbed and pulled. Pulling of this end causes wrapped neck portion of balloon to roll or slide towards distal end (8) of retaining element (2). Complete removal of wrapped neck portion from retaining element (2) in this manner results in a knotted balloon neck.

An advantage of this device is that the simplicity of the invention itself allows for variations by the user. For instance, a line may be incorporated into the process by joining it with the balloon neck portion before wrapping around retaining element (2). The line may of course be string, yarn, or the like, and may also be a stick of some sort when helium is not used to inflate the balloon.

Furthermore, this device allows for a plurality of balloons to be tied using an altered method. In this method, two balloons are inflated and their neck portions joined together. A single 360° twist of balloon necks may be sufficient to insure a good knot. The inflated balloons are then positioned on underside of retaining element (2), opposite opening (3), so that inflated portion of balloons point away from retaining element (2). Neck portions of the balloons, lying on opposite sides of retaining element (2) are wrapped around retaining element (2) and crossed over opening (3). At this point one of these ends is fed between retention element (5), through opening (3) and back through hole (10) in retaining element (2). Removal to form the knotted balloons is exactly similar to that for a singular balloon. To those skilled in the art, this process is well suited to a technique called "stacking," in which balloons are tied together and fastened to a line to form decorative columns.

I claim:

1. A device for tying an elastic balloon comprising:
   a. a bracket having two ends;
   b. a retaining element having an external surface and a distal edge connected to one end of said bracket at an intersection between said bracket and said retaining element, and defining a hole having a rim which defines a plane, the retaining element acting upon an elastic balloon in operation of the device;
   c. a means for allowing removal of said elastic balloon from said retaining element after it has been tied;
   d. a retention element; and
   e. a means for reducing friction wherein said means for reducing friction comprises:
      i. a smooth texture on said external surface of said retaining element; and
      ii. a radius along said intersection between said bracket and said retaining element.

2. A device for tying an elastic balloon as described in claim 1 wherein the means for reducing friction comprises a (poly(tetrafluoroethylene)) coating on said retaining element.

3. A device for tying an elastic balloon as described in claim 1 wherein the means for reducing friction comprises a silicon coating on said retaining element.

* * * * *